US012270299B2

(12) United States Patent
Hakulinen et al.

(10) Patent No.: US 12,270,299 B2
(45) Date of Patent: Apr. 8, 2025

(54) SCRAPER, ROCK DRILLING UNIT AND METHOD

(71) Applicant: SANDVIK MINING AND CONSTRUCTION OY, Tampere (FI)

(72) Inventors: Johannes Hakulinen, Tampere (FI); Juha Piispanen, Tampere (FI); Sirpa Launis, Tampere (FI); Jussi Huhtanen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 50 days.

(21) Appl. No.: 18/129,229

(22) Filed: Mar. 31, 2023

(65) Prior Publication Data

US 2023/0313618 A1 Oct. 5, 2023

(30) Foreign Application Priority Data

Apr. 1, 2022 (EP) ..... 22166335

(51) Int. Cl.
*E21B 12/06* (2006.01)
*E21B 7/02* (2006.01)
*E21B 19/08* (2006.01)

(52) U.S. Cl.
CPC ..... *E21B 7/025* (2013.01); *E21B 12/06* (2013.01); *E21B 19/08* (2013.01)

(58) Field of Classification Search
USPC ..... 173/1
See application file for complete search history.

(56) References Cited

U.S. PATENT DOCUMENTS 7,614,463 B1 * 11/2009 Hunziker ..... E21B 12/06 175/84
2015/0176337 A1 * 6/2015 Ditillo ..... E21B 7/005 175/84

FOREIGN PATENT DOCUMENTS

| | | | |
|---|---|---|---|
| CN | 114000825 | A | 2/2022 |
| CN | 114215566 | A | 3/2022 |
| EP | 3144466 | A1 | 3/2017 |
| WO | 2009136842 | A1 | 11/2009 |

* cited by examiner

*Primary Examiner* — Chinyere J Rushing-Tucker
(74) *Attorney, Agent, or Firm* — Corinne R. Gorski

(57) ABSTRACT

A scraper, rock drilling unit, and a method of cleaning a feed beam of a rock drilling unit is provided. The scraper includes a scraper element and a bracket mountable to the feed beam. The bracket provides the scraper element with a floating support. There is at least one force element provided for generating a force for moving the scraper element in relation to the bracket.

11 Claims, 3 Drawing Sheets

SCRAPER, ROCK DRILLING UNIT AND METHOD

RELATED APPLICATION DATA

This application claims priority under 35 U.S.C. § 119 to EP Patent Application No. 22166335.4, filed on Apr. 1, 2022, which the entirety thereof is incorporated herein by reference.

TECHNICAL FIELD

The invention relates to a scraper for a feed beam of a rock drilling unit of a rock drilling rig. The invention further relates to a rock drilling rig and to a method of cleaning a feed beam of a rock drilling unit.

BACKGROUND

In mines and at other work sites different type of rock drilling rigs are used for drilling drill holes into rock surfaces. The rock drilling rigs are provided with rock drilling units including feed beams and rock drilling machines mounted movably on the feed beams by means of carriages. Typically, there are slide elements between the feed beam and the carriage for providing proper support. Different slide element solutions have been developed but they have shown some disadvantages.

SUMMARY

An object of the invention is to provide a novel and improved scraper, a rock drilling unit, and a method for cleaning a feed beam of a rock drilling unit.

An idea of the disclosed solution is that a rock drilling unit can be provided with one or more scrapers. The scraper includes a scraper element, a bracket mountable to a feed beam and configured to provide the scraper element with floating support, and one or more force elements for generating force for moving the scraper element in relation to the bracket.

In other words, the scraper is kept continuously against an outer surface of the feed beam, such that the scraper element removes drilling cuttings and other debris and dirt away.

An advantage of the disclosed solution is that the scraper element can protect structures of the rock drilling unit from wear. Especially, the scraper can extend service life of slide elements between the feed beam and a carrier. Wearing of the scraper element is compensated automatically by means of the force element feeding the scraper element towards the feed beam. A further advantage is a simple and inexpensive structure.

According to an embodiment, the scraper element is a scraper blade having plate-like configuration. In other words, the scraper element may be a relatively simple plate-like piece.

According to an embodiment, the scraper blade is cut from plate material. Then manufacture of the scraper blade is easy and inexpensive.

According to an embodiment, the scraper element is made of polymer material.

According to an embodiment, the scraper element is made of polyurethane (PU).

According to an embodiment, the scraper element is made of polyamide (PA).

According to an embodiment, the scraper blade is manufactured by additive manufacturing (AM) techniques.

According to an embodiment, a free end of the scraped element configured to face towards the feed beam has V-shaped profile. In other words, the scraper element is shaped in accordance with the shape of the feed beam.

According to an embodiment, the force element is a spring element. In other words, the scraper element is pushed towards the feed beam by means of one or more spring elements.

According to an embodiment, the spring element is a helical spring.

According to an embodiment, the spring element is arranged between the scraper element and the bracket.

According to an embodiment, the force element is an actuator. In other words, the scraper comprises one or more actuators for moving the scraper element.

According to an embodiment, the actuator is a pressure medium operated actuator, such as a hydraulic or pneumatic cylinder, or a motor.

According to an embodiment, the actuator is an electrically operable actuator, such as an electric motor, or a linear motor.

According to an embodiment, the force element includes at least one resilient compressible element. In other words, operation of the force element may be based on materialistic properties, such resiliency and compressibility.

According to an embodiment, the resilient material of the force element may be rubber or rubber-like polymeric material.

According to an embodiment, the scraper element includes a free space surrounding the bracket whereby the scraper element is movable at least in two movement axes relative to the bracket. In other words, the floating support configuration of the scraper is based on the free space between the bracket and the scraper element. The force element can push the scraper element towards the feed beam, but some adjustment movements are still possible if relative transverse movements occur between the feed beam and the carrier.

According to an embodiment, the force element, such as a spring element, is mounted to the mentioned free space.

According to an embodiment, the bracket includes fastening means for fastening it immovably. The fastening means may have one or more screw holes, allowing it to be bolted.

According to an embodiment, the scraper includes a cover plate mounted on the bracket and covering the free space.

According to an embodiment, the disclosed solution relates to a rock drilling unit of a rock drilling rig. The rock drilling unit has an elongated feed beam, a carriage mounted slidably on the feed beam, a rock drilling machine mounted on the carriage, a feed device for moving the carriage together with the rock drilling machine on the feed beam, and several slide elements between the carriage and the feed beam for supporting the carriage. Further, the feed beam is configured to be cleaned by means of at least one scraper mounted to the carrier and including a scraper element being forced against an outer surface of the feed beam and on the same side of the feed beam where there is at least one of the mentioned slide elements. The scraper is in accordance with the features and embodiments disclosed herein. The scraper element of the scraper wipes drilling cuttings away from critical surfaces of the feed beam and closes a gap between the feed beam and the carriage so that wearing of the slide elements is decreased.

According to an embodiment, the material of the scraper element has a lower hardness compared to material of the feed beam, whereby the scraper element is a sacrificing element and can wear.

According to an embodiment, the rock drilling unit includes the scrapers on two opposite surfaces of the feed beam.

According to an embodiment, the scraper has a floating mounting configuration allowing movement of the scraper element in direction of y and z axes, which are both transverse to longitudinal direction of the feed beam. Thus, the scraper element has two degrees of freedom. In the z axis direction, i.e., in the longitudinal direction of the feed beam, the movement of the scraper element is prevented in relation to the bracket.

According to an embodiment, the disclosed solution relates to a method of cleaning a feed beam of a rock drilling unit. The rock drilling unit includes a carrier supported movably on the feed beam by means of several slide elements, and a rock drilling machine mounted on the carrier. The method includes cleaning the outer surface of the feed beam by means of at least one scraper including a scraper element, keeping the scraper element against the feed beam by means of at least one force element thereby preventing formation of a gap between the scraper element and the feed beam, and further, sweeping away drilling cuttings, and providing the scraper element with a floating mounting, whereby the scraper element is movable at least in two movement axis.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

For the sake of clarity, the figures show some embodiments of the disclosed solution in a simplified manner. In the figures, like reference numerals identify like elements.

DETAILED DESCRIPTION

Figure 1:
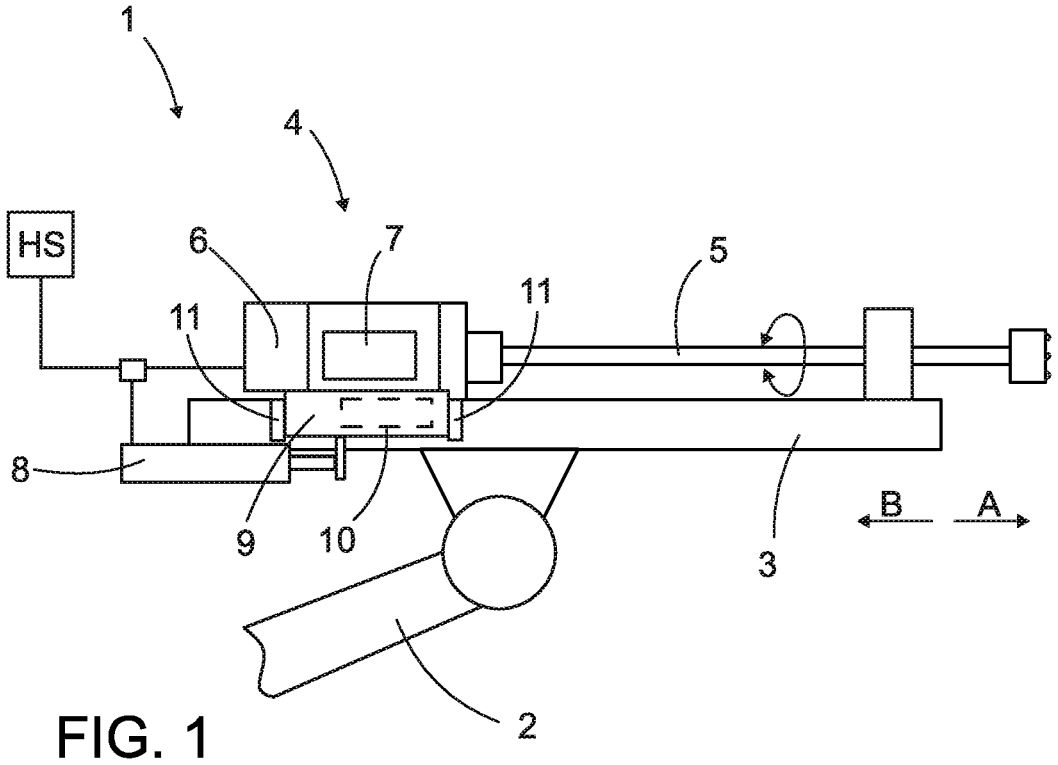
FIG. 1 is a schematic side view of a rock drilling unit.

FIG. 1 discloses a rock drilling unit 1 mounted to a drilling boom 2 of a rock drilling rig. The rock drilling unit 1 includes a feed beam 3 and a rock drilling machine 4 supported thereon. A drilling tool 5 is connectable to the drilling machine 4.

The rock drilling machine 4 may include an impact device 6 and a rotating device 7. The rock drilling machine 4 may be moved in drilling direction A and in return direction B on the feed beam 3 by means of a feed device 8. The rock drilling machine 4 and the feed device 8 may be hydraulically operable and may be connected to a hydraulic system HS.

Between the feed beam 3 and the rock drilling machine 4 may be a carriage 9, i.e., the rock drilling machine 4 may be mounted on the carriage 9. Then, the feed device 8 is arranged to move the carriage 8 together with the rock drilling machine 4 on the feed beam 3. There may be several slide elements 10 provided between the carriage 9 and the feed beam 3 for supporting the carriage 9.

The feed beam 3 can be cleaned by means of one or more scrapers 11 mounted to the carrier 9 on the same side of the feed beam 3, where there is at least one of the mentioned slide elements 10. Thus, on both lateral sides of the feed beam 3 there may be two scrapers 11, one on both ends of the carriage 9. The number of the scrapers 11 may be selected on a case-by-case basis, as well as by their mounting principles. The scraper 11 may be in accordance with the features and embodiments disclosed.

Figure 2:
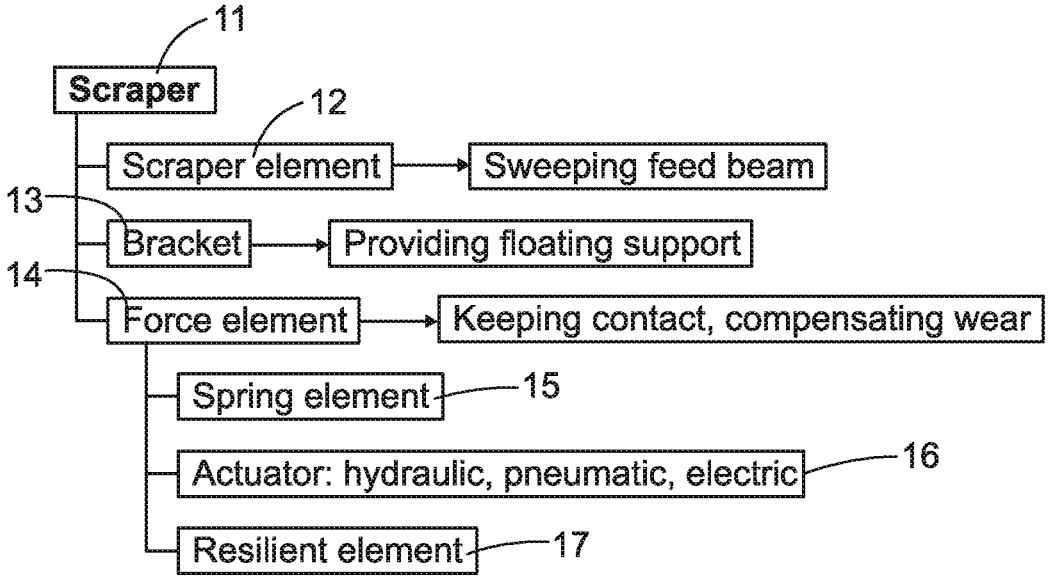
FIG. 2 is a schematic diagram showing some features of a scraper.

FIG. 2 illustrates scraper 11 including a scraper element 12 by means of which a feed beam can be wiped of drilling cuttings and other material harmful for the slide elements and surfaces of the moving system of a rock drilling unit.

The scraper 11 further includes a bracket 13, which may be mounted to the feed beam, and which can provide the scraper element 12 with floating support in at least to movement directions.

A force element 14 is arranged to generate forces for moving the scraper element 12 in relation to the bracket 13. This way the scraper element 12 is kept in contact with the feed beam and the wear of the scraper element is also compensated. In addition, a gap between the scraper element 12 and the feed beam is closed so that that drilling cuttings and alike cannot enter between the slide elements and the feed beam. The force element 14 may be a spring element 15, an actuator 16 or a resilient element 17.

Figure 3:
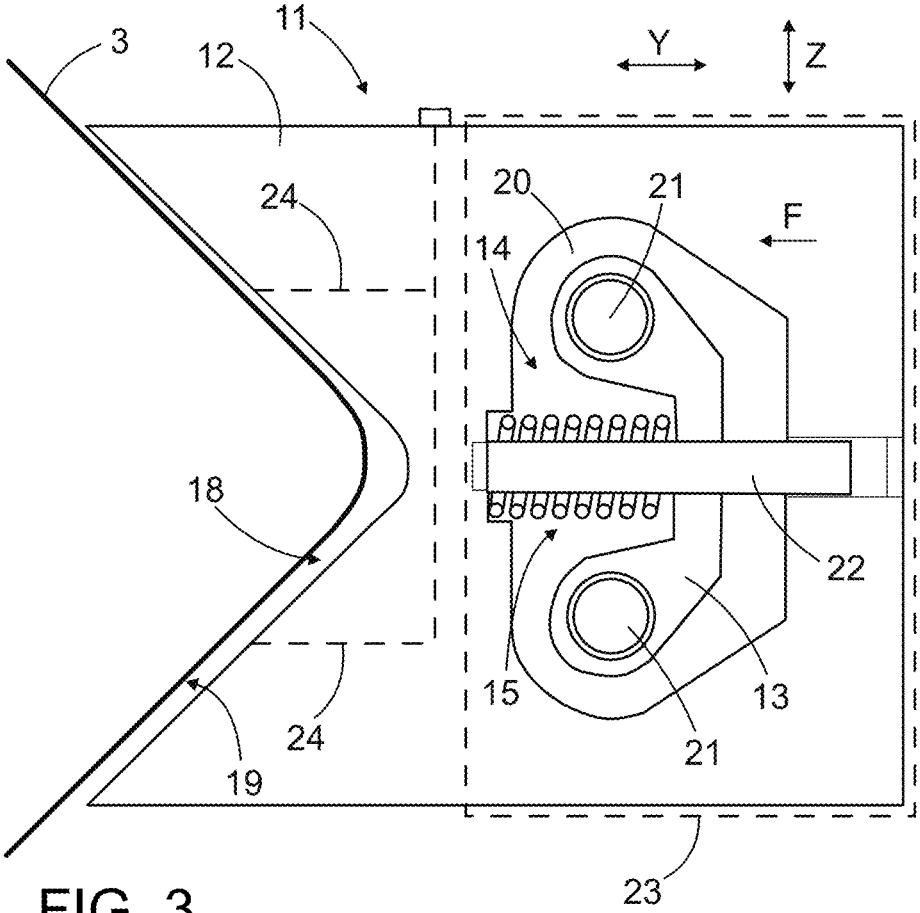
FIGS. 3-5 are schematic side views of structures of scrapers according to different embodiments.

FIG. 3 discloses a scraper 11 having scraper element 12 with a V-shaped contact surface 18 facing towards feed beam 3. The shape of the contact surface 18 can be designed in accordance with an outer profile 19 of the feed beam 3. The scraper element 12 has a plate-like configuration and includes a free space 20 surrounding a bracket 13. Thus, the scraper element 12 can move in two movement axes, Y and Z, relative to the bracket 13, which is mounted immovably by means of fastening screws 21. Spring element 15 serves as a force element 14 and pushes the scraper element 12 towards the feed beam 3. A pin 22 provides the spring element 15 with needed support. A cover plate 23 may be mounted on the bracket 13 so that the free space 20 is covered. The cover plate 23 may be arranged to protect the mechanism of the scraper from impurities, moisture and external forces.

FIG. 3 illustrates that there may be flushing or lubricating channels 24 for conveying flushing or lubricating fluid flows between the surfaces 18, 19.

Figure 4:
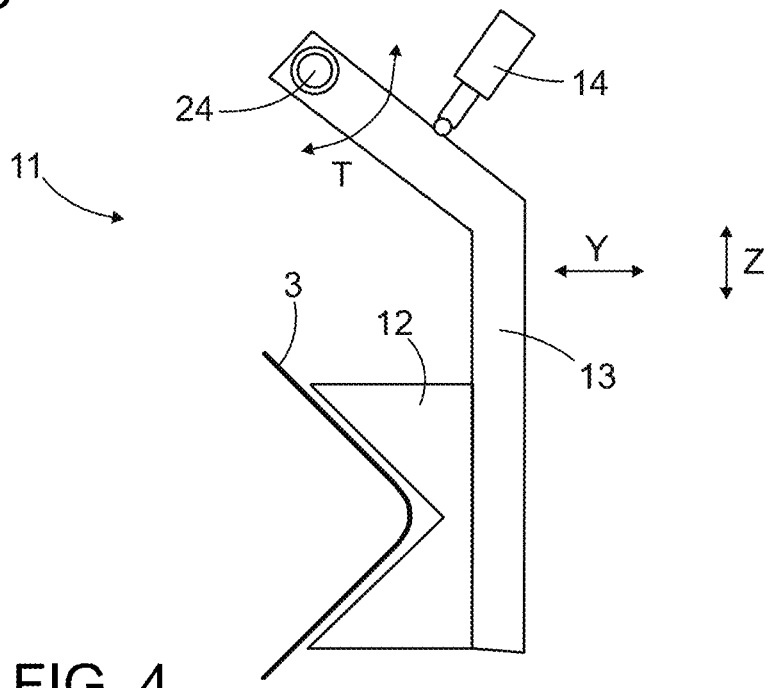

FIG. 4 discloses a scraper 11 wherein a bracket 13 is an arm, which can be turned in direction T in relation to a fulcrum 24 by means of a force element 14. A scraper element 12 is mounted at a free and of the elongated bracket 13 and it has a floating mounting.

Figure 5:
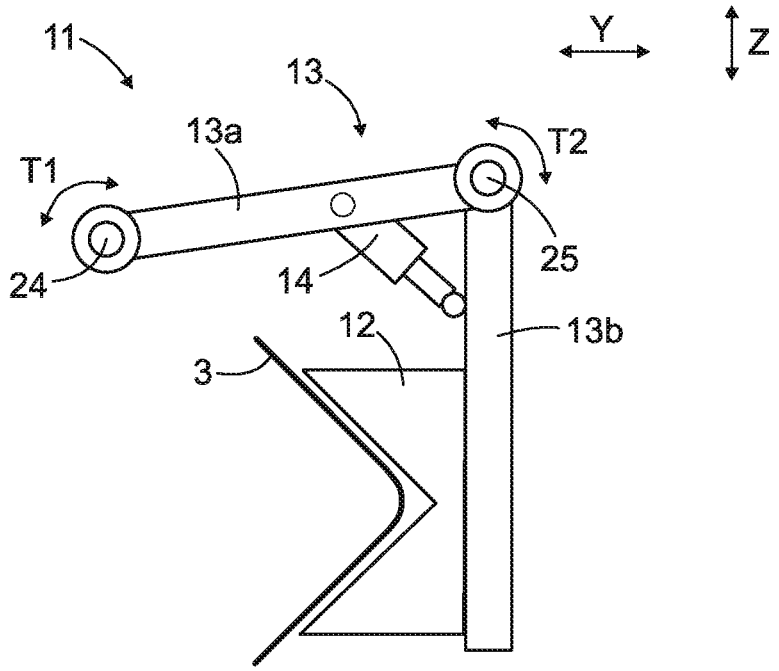

FIG. 5 discloses a scraper 11 wherein bracket 13 has two arms 13*a*, 13*b*, which can be turned in direction T1 in relation to a fulcrum 24 and turn in direction T2 relative to each other around a joint 25 by means of force element 14. A scraper element 12 is mounted at a free and of the arm 13*b* and it has a floating mounting.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A scraper for a feed beam of a rock drilling unit, the scraper comprising:

a scraper element;

a bracket mountable to the feed beam and configured to provide the scraper element with floating support; and at least one force element for generating force for moving the scraper element in relation to the bracket, wherein the scraper element is arranged to be kept continuously against an outer surface of the feed beam.

2. The scraper as claimed in claim 1, wherein the scraper element is a scraper blade having a plate-like configuration.

3. The scraper as claimed in claim 1, wherein the scraper element is made of a polymer material.

4. The scraper as claimed in claim 1, wherein a free end of the scraper element is configured to face towards the feed beam and has a V-shaped profile.

5. The scraper as claimed in claim 1, wherein the at least one force element is a spring element.

6. The scraper as claimed in claim 1, wherein the at least one force element is an actuator.

7. The scraper as claimed in claim 1, wherein the at least one force element includes at least one resilient compressible element.

8. The scraper as claimed in claim 1, wherein the scraper element includes a free space surrounding the bracket, whereby the scraper element is movable along at least two movement axes relative to the bracket.

9. The scraper as claimed in claim 8, further comprising a cover plate mounted on the bracket and covering the free space.

10. A rock drilling unit of a rock drilling rig, the rock drilling unit comprising:

an elongated feed beam;

a carriage mounted slidably on the feed beam;

a rock drilling machine mounted on the carriage;

a feed device arranged for moving the carriage together with the rock drilling machine on the feed beam; and a plurality of slide elements disposed between the carriage and the feed beam for supporting the carriage, wherein the feed beam is configured to be cleaned by at least one scraper mounted to the carriage and having a scraper element being forced against an outer surface of the feed beam and on a same side of the feed beam where there is at least one of the plurality of slide elements, and wherein the scraper is in accordance with claim 1.

11. A method of cleaning a feed beam of a rock drilling unit, wherein the rock drilling unit includes a carrier supported movably on the feed beam by a plurality of slide elements, and a rock drilling machine mounted on the carrier, the method comprising:

cleaning an outer surface of the feed beam by at least one scraper having a scraper element;

keeping the scraper element against the feed beam by at least one force element thereby preventing formation of a gap between the scraper element and the feed beam;

sweeping away drilling cuttings; and providing the scraper element with a floating mounting, whereby the scraper element is movable along at least two movement axes.

* * * * *